United States Patent [19]

Salomon

[11] 4,169,325

[45] Oct. 2, 1979

[54] SKI BOOT

[75] Inventor: Georges P. J. Salomon, Annecy, France

[73] Assignee: Etablissements Francois Salomon et Fils, Annecy, France

[21] Appl. No.: 761,764

[22] Filed: Jan. 24, 1977

[30] Foreign Application Priority Data

Jan. 27, 1976 [FR] France ..... 76 02167

[51] Int. Cl.[2] ..... A43B 3/00

[52] U.S. Cl. ..... 36/117

[58] Field of Search ..... 36/117, 118, 119, 120, 36/121, 10

[56] References Cited

U.S. PATENT DOCUMENTS

| | | | |
|---|---|---|---|
| 3,786,580 | 1/1974 | Dalebout | 36/117 |
| 3,834,044 | 9/1974 | McAusland et al. | 36/117 |
| 3,896,202 | 7/1975 | Palac | 36/117 |

FOREIGN PATENT DOCUMENTS

| | | | |
|---|---|---|---|
| 2545807 | 5/1976 | Fed. Rep. of Germany | 36/117 |

*Primary Examiner*—Patrick D. Lawson

*Attorney, Agent, or Firm*—Pollock, Vande Sande & Priddy

[57] ABSTRACT

A ski boot comprises an outer shell and a detachable inner element constituting a lining and defining a cavity, the volume of which depends upon the size of the user's foot and is adapted to accommodate a filler material. A sealing device is located between the shell and the inner element for closing off the cavity. The ski boot is particularly well suited to allowing the skier to withdraw the inner element and the filler material, either to dry out any moisture that may have entered the boot or to be able to re-use the boot and adapt it to another foot, or to change a worn inner element.

14 Claims, 13 Drawing Figures

(a)
(b)

SKI BOOT

The present invention relates to a ski boot and more particularly to a boot comprising a sealing device making it possible to adapt a ski boot to a skier's foot.

Ski boots are known which comprise an outer shell and an inner element constituting a lining (or slipper) defining, with the shell, a cavity adapted to accommodate a filler. The filler may be a fluid. Thus a self-molding or hardening compound may be introduced into the cavity, more particularly by injection. These ski boots are particularly suitable for adapting the boot to the skier's foot, so that the movements thereof are transmitted faithfully to the ski, without injuring or bruising the foot.

Ski boots of this kind are described in French Pat. Nos. 2,204,106 and 2,166,903, both issued to Hanson; German Pat. No. 2,351,757 (Hanson); Swiss Pat. Nos. 561,030 (Hanson) and 533,963 (Wagner). The Hanson patents, in particular, relate to the injection of a hardenable material between the shell of the boot and the inner element constituting the lining, either by filling a bladder or by filling the cavity formed between the shell and the inner element. However, none of the cited Hanson patents indicates, in the case of the latter embodiment, exactly how a seal is assured upon injection, under pressure, of a fluid product between the outer shell and the inner element.

The above-mentioned Wagner reference describes an inner element constituting a lining and secured around the boot upper in order to prevent any leakage of the filler material.

These ski boots have major disadvantages.

For example, it is obvious that if the inner element is permanently attached to the shell, as in the case of the boot described by Wagner, it is impossible to use the boot again for a new injection of filler material; now, it may be very advantageous to remove an initial injection molding and to replace it with another, either if the first injection is defective, or to fit the boot to the foot of another skier. Moreover, securing the inner element permanently to the shell requires an additional assembly operation during manufacture, the economic effect of which may be undesirable. Furthermore, these ski boots make it possible to eliminate moisture between the shell and the lining. This moisture, which may be produced by perspiration or by unwanted entry of snow or water, is detrimental to the lining (especially if the lining is made of leather).

If the filler material is injected into a bladder, as in the case of the Hanson boots, it is possible in certain cases to remove the bladder from the boot after use, either to re-use it and to adapt it to the foot of another skier, or to dry it in order to remove the moisture that may have formed between the shell and the inner element.

However, this type of boot cannot be produced economically, since it needs a separate element, namely, a bladder to form a cavity to accommodate the filler material.

It is an object of the present invention to overcome the foregoing disadvantages of the boots made according to the prior art and, more particularly, to provide a ski boot which (a) may be produced conveniently and economically;

(b) naturally presents a cavity adapted to receive a filler permitting adaptation to the skier's foot; and (c) makes it possible for the filler to be extracted to allow the shell of the boot to be properly dried, or to provide a boot adapted to the foot of another skier.

According to one feature of the present invention, these objects are achieved in that the cavity is defined between an inner element constituting a lining and arranged detachably within the shell, the internal wall of the shell, and a sealing device located between the shell and the inner element. It is possible to separate the sealing device from the shell, from the inner element, or from both. This combination of arrangements allows the present invention to achieve the above-mentioned objectives, it being clear that:

(a) the boot can be produced conveniently and economically, since the cavity is formed by a single complementary element, namely, the sealing device, so that there is no need of a bladder for the filler material;

(b) the boot may be adapted to the skier's foot in a manner known per se, since it comprises a sealed cavity into which a filler material may be injected; and (c) finally, the boot has the advantage that the inner element forming the lining may be removed and the filler material may be extracted in order to dry it or to replace it with another better adapted to the skier's foot, or with new material.

The detachable device constituting one of the characteristic elements of the boot according to the invention may be made in various ways; it may consist of system of lips, a pad, or an inflatable tube. This sealing device may be integral with, and produced at the same time as, the shell, or at the same time as the inner element constituting the lining, especially when the shell and the inner element are injection-mold; it may be fitted in the course of a subsequent operation, either to the shell of to the inner element. The shape and arrangement of the sealing device are governed by the part of the foot to which it is desired to adapt the boot. For example, the sealing device may be designed to be fitted sealingly to the inner element or to the outer shell, to form a filler cavity at the level of the skier's heel or on top of his foot; it may also be designed to leave only the toes or the bottom of the leg free.

It should be noted that, in order to inject the filler material into the cavity between the shell and the inner element, it is preferable for the skier to have already introduced his foot into the boot, since presence of the foot, or of a pattern replacing it, may assist the sealing device in performing its sealing function, as a result of the pressure applied thereto. When the filler material is injected into the cavity, the inner element is forced to assume the shape of the foot, and the sealing device prevents the filler material from escaping to the outside of the boot.

If it is not desired to inject onto a foot or a mold, provision may be made to cause the seal to adhere to the part to which it is not attached during manufacture. An adhesive, or a mechanical device such as VELCRO (trademark) will provide this adhesion and assure a seal in the absence of the foot, while still remaining detachable because of the small area of the adhering surfaces. The adhesive may even be applied in the presence of the foot.

Finally, in order to allow the injection to be carried out conveniently, it may be desirable to provide an air-outlet aperture, if the seal prevents the escape of air.

As a variant, the seal may be designed to pass air but not the liquids injected.

It is also quite obvious that the seal may be made mobile, so that it may be placed wherever it best suits the user's foot.

A few variants of the ski boot according to the invention will now be described non-restrictively, in conjunction with the drawing attached hereto, wherein.

Figure 1:
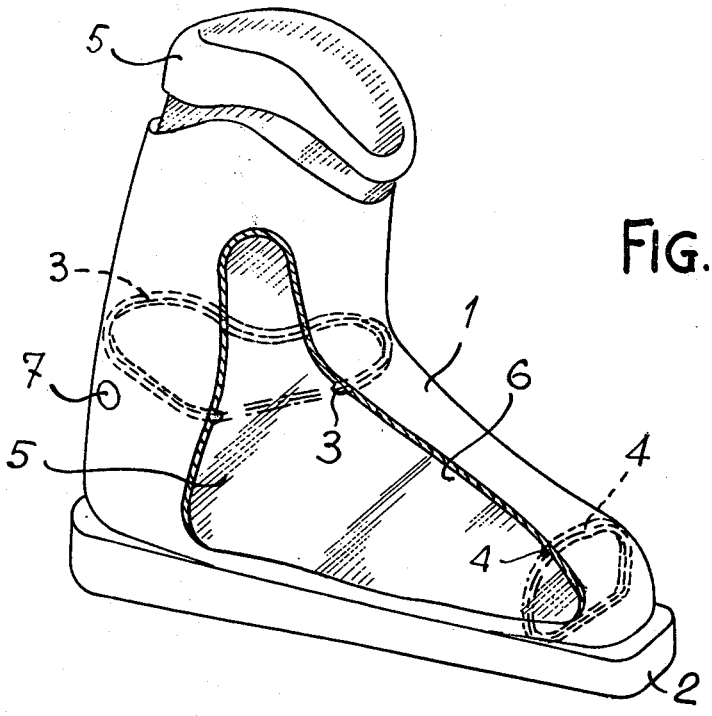
FIG. 1 is a broken-away perspective view of a possible arrangement of the sealing device, and of a possible structure of the device.

Referring to FIG. 1, the boot comprises an outer shell 1 assembled to a sole 2. This figure does not show the opening and closing systems, known per se, which allow the skier to introduce his foot more conveniently into the boot, since these systems are not a part of the present invention. It is, however, clear that the boots according to the invention may comprise hook or lace fastening means. The shell is made of synthetic material, more particularly by molding and by injection. It has two internal pads, also produced during the injection-molding of the shell, arranged according to contours 3 and 4. Resting upon these pads is an inner element constituting a lining 5 and made of polyurethane, for example. In conjunction with the outer shell and sealing devices 3,4 formed by the pads, this inner element defines a cavity 6 communicating with the outside through an orifice 7 designed to allow injection into cavity 6 of filler material, e.g., of the type described by applicant in U.S. patent application Ser. No. 726,738 filed Sept. 27, 1976, entitled "Method for obtaining a polystyrene foam and new industrial products", and U.S. patent application Ser. No. 622,688, filed Oct. 15, 1975, now U.S. Pat. No. 4,120,064, "Method for fitting a ski boot to the skier's foot and a ski boot according to said method".

The location of sealing device 3 permits injection onto the forward part of the foot and onto the heel, leaving the ankle-bones free. The location of sealing device 4 permits injection in a forward direction, leaving the toes free. It is obvious that the presence of the foot in the boot contributes to the sealing effect of sealing devices 3,4, since it pushes inner element 6 against pads 3,4.

Since inner element 5 is not permanently secured either to pads 3,4 or to the shell, it is possible to remove this element from the boot. It then also becomes possible to extract the filler material, either to dry it and remove the moisture, or to re-use the boot by adapting it to the shape of another skier's foot, or to change a worn lining. It is important to note that the injected material, when it solidifies, must not adhere to the inside of the shell. To this end, the inside of the shell may be provided with an anti-adhesive coating (with a silicone base, for example). However, the injected material may adhere to the lining, since this will make it easier to extract from the shell and to replace, but the injected material may also be prevented from adhering to the lining, should this be desirable.

Figure 2:
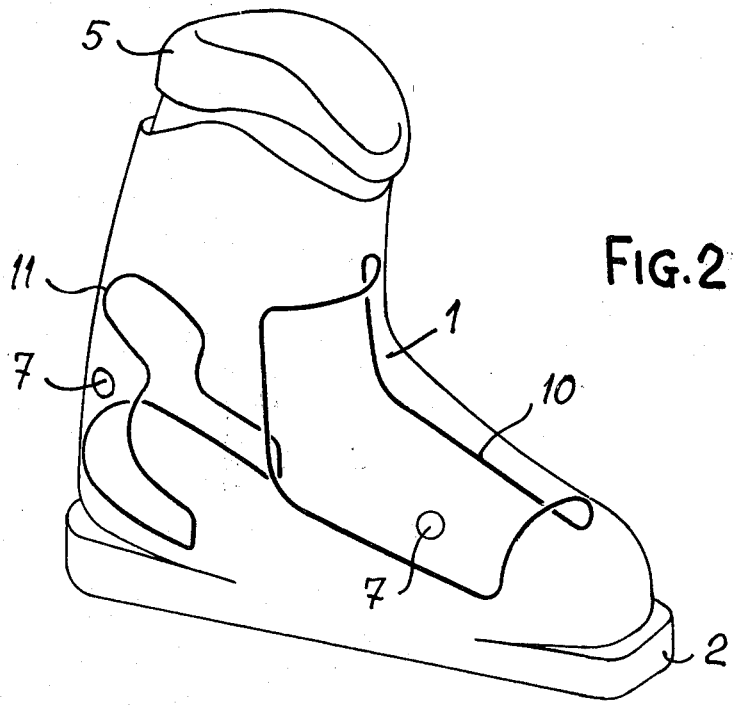
FIG. 2 is a perspective view of a variant of the above, illustrating diagrammatically another possible arrangement of the sealing device.

Referring to FIG. 2, the sealing device may be in the form of a pad injection-molded at the same time as the outer shell. It may also be of a totally different type, as will be explained hereinafter in conjunction with FIGS. 5 to 13. Most of the elements described in FIG. 1 will be recognized in FIG. 2, especially shell 1 and sole 2, lines 10, 11 representing diagrammatically the closed contours of the sealing device inside the boot. As may be seen from this figure, device 10 makes it possible to form a cavity only on the forward part of the skier's foot and instep, whereas device 11 makes it possible to form a cavity on the skier's heel, leaving the ankle bones free.

Figure 3:
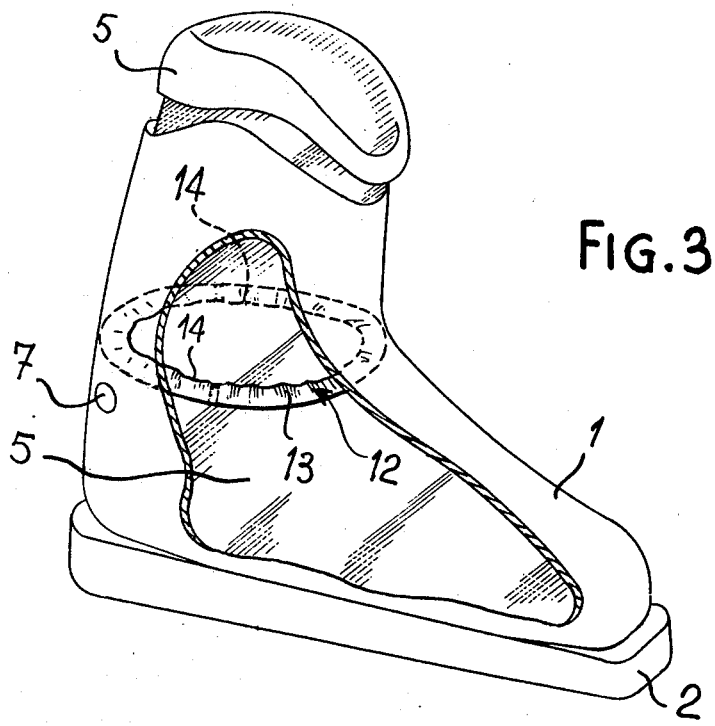
FIG. 3 is a broken-away perspective view of another variant of the sealing device.

In FIG. 3, it is possible to recognize outer shell 1, sole 2, and the inner element described in conjunction with FIG. 1. In this case, sealing device 12 which surrounds the skier's ankle, leaving the ankle bones free, consists of a circular collar 13, the inner edge of which comprises a rubber band 14. This surrounds and grips the inner element constituting the lining, thus making a fabric seal.

It will be noted that lining 5 is not assembled to edge 14 of circular collar 13, and the skier may therefore remove the lining from the boot if he so desires.

It will further be observed that, in the case of this variant, the toes are also enclosed in the filler material.

Figure 4:
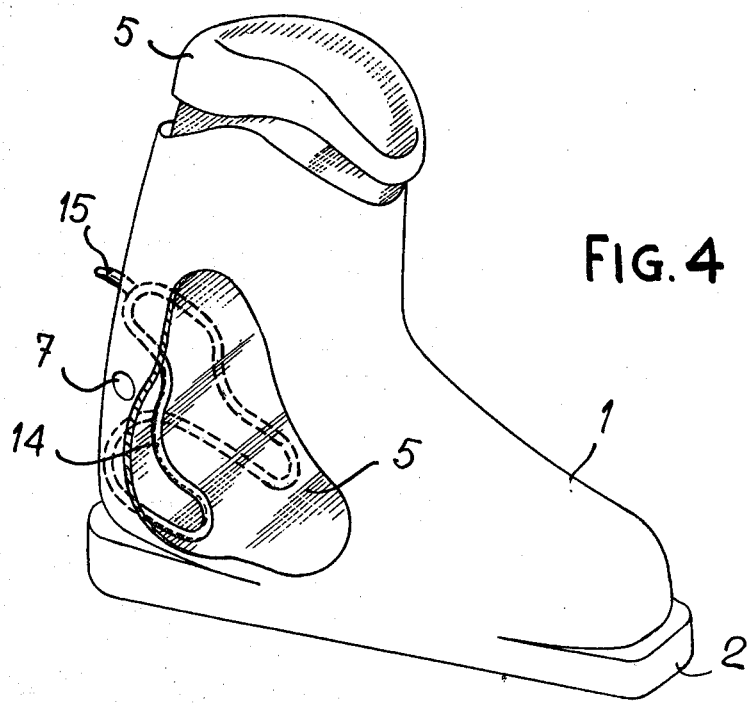
FIG. 4 is a broken-away perspective view of a boot comprising a sealing device of the inflatable type.

In FIG. 4, the contour of the sealing device is the same as that marked 11 in FIG. 2. It is designed to form a cavity on the skier's heel, leaving the ankle bones free. In this variant, the sealing device consists of an inflatable tube 14 integral with inner element 5, the tube being accessible from the outside by means of a valve 15 passing through the shell and making it possible to inflate or deflate the tube at will; the inflatable tube may be assembled to, and made integral with, inner element 5, more particularly by means of an adhesive.

It is obvious that when sealing device 14 is inflated, the inner element is pressed against the skier's foot, thus providing a seal between the outer shell and inflatable element 14.

A brief description will now be given of FIGS. 5 to 13 which illustrate, as non-restrictive examples, a plurality of variants of the sealing device. In each of these figures, inner element 5 and outer shell 1 of the boot are shown in section (a) in their initial configurations, and (b) in their sealing positions.

Figures 5, 6, 7, 8, 9, 10, 11, 12, 13:
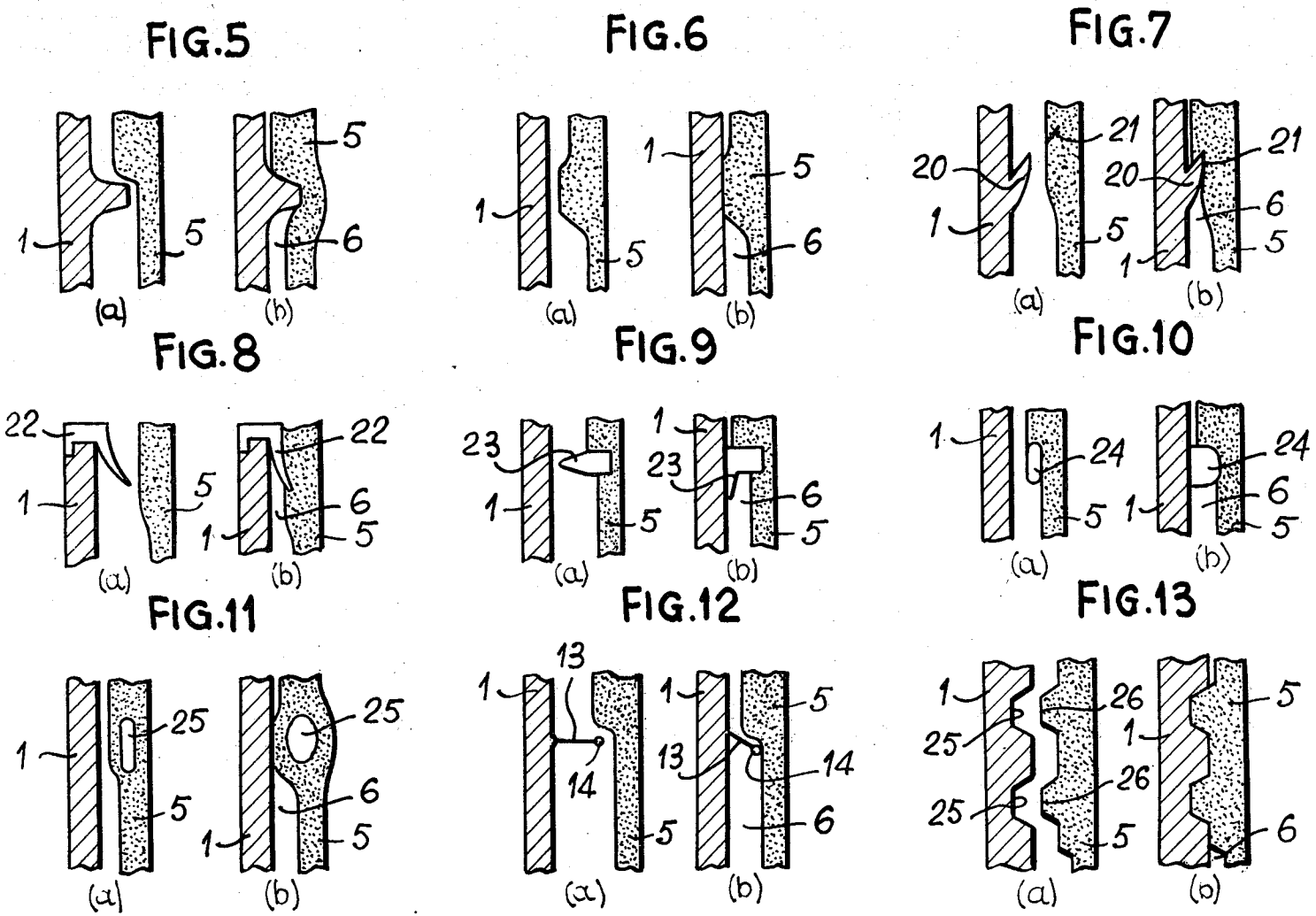
FIGS. 5 to 13 are sections illustrating sundry possible variants of the sealing device.

In the system shown in FIG. 5, sealing is assured by means of a pad on the shell of the boot which compresses the foam of the lining, as described in conjunction with FIG. 1.

In the system shown in FIG. 6, the inner element comprises a pad which is crushed against outer shell 1 of the boot to produce a seal, when the skier introduces his foot into the boot.

In the system shown in FIG. 7, outer shell 1 of the boot comprises an injection-molded lip 20 designed to enter a notch 21 in the thickness of the inner element. This arrangement obviously provides a seal between the shell and the inner element.

In the system shown in FIG. 8, outer shell 1 of the boot comprises a lip 22 glued or welded to wall 1; when inner element 5 is introduced into the boot, the resilience of the lip allows it to deflect and to enter the thickness of the lining, which is made of polyurethane, for example, and thus to provide a seal.

In the system shown in FIG. 9, inner element 5, made of polyurethane foam, for example, has a semi-resilient lip fitted, more particularly, by gluing and also made of polyurethane foam, for example. Deflection of this lip against the shell of the boot provides a seal.

In the system shown in FIG. 10, the inner element, made of polyurethane foam, for example, is secured, more particularly by gluing, to tube 24 which is made of rubber or the like and can be inflated, as described in connection with FIG. 4, for the purpose of providing a seal between shell 1 and inner element 5.

In the system shown in FIG. 11, inner element 5, made of polyurethane foam, for example, has a tube 25 within its thickness. This tube is deformed by inflation and thus provides a seal between shell 1 and inner element 5.

In the system shown in FIG. 12, the shell is fitted with a collar 13, the inner edge of which has a rubber band 14 which provides a seal as described in connection with FIG. 3. It will be observed that inner element 5 has a shoulder against which the resilient inner edge of the sealing device bears; this prevents the collar from being lifted by the pressure at the time of injection.

In the system shown in FIG. 13, outer wall 1 has grooves 25. Projections 26, integral with inner element 5, which is made of polyurethane, for example, fit into these grooves, thus providing a seal between shell 1 and inner element 5.

All of these designs are given by way of example and are in no way restrictive. Moreover, variants may be obtained by replacing separately fitted elements by molded elements and vice-versa.

The foregoing designs are specially intended for use with inner elements made of synthetic foam and an outer shell made of a rigid synthetic materials, but comparable systems may be designed particularly use with other materials, for example leather.

The types of sealing devices described above depend, for their use, upon the location of the cavity they are intended to define. For instance, the design shown in FIG. 9 is particularly suitable for providing a seal at the end of the foot, as shown by the contour of sealing device 4 in FIG. 1, since the introduction of the inner element into the boot bends the lip backwards and assures a perfect seal. The variants shown in FIGS. 8 and 12 are preferable for assuring a seal around the ankle, as shown by the contour of sealing device 3 in FIG. 1. Sealing devices having complex contours, as shown diagrammatically in FIG. 2, should be designed as shown in FIGS. 5, 6, 10, 11 and 13, since in these variants sealing is not dependent upon the direction in which a lip is bent.

The inflatable-tube systems shown in FIGS. 10 and 11 have the advantage of being able to be deflated after the filler material has been injected, and this eliminates any sores on the leg which may be produced by the sealing device. In the case of the systems shown in FIGS. 8, 9 and 12, it should be noted that the higher the pressure of the injected material, the better the seal, since the filler material deforms the sealing device (the lip or the extensible fabric) in a direction which increases the sealing effect. The systems shown in FIGS. 8, 9 and 12 will be limited in the extent to which they can be made use of. A sealing device such as that shown in FIG. 9 is well adapted to prevent the entry of moisture at the upper edge of the boot, since lip 23, fitted to the inner element, naturally bends upwardly when the lining is introduced into the boot.

The different sealing devices according to the invention may be used either to prevent the filler material from escaping from the boot, or to prevent moisture from entering the shell and the inner lining. The lip may be directed inwardly or outwardly, depending upon the direction in which the maximal sealing effect is required.

A hardenable material is preferable injected, in a manner known per se, into the cavity formed by the outer shell, the inner element constituting the lining, and the sealing device; the cavity structures according to the present invention may be used in injecting other materials. Filler materials are preferably selected so that they will not adhere to the inner element or to the outer shell, in order to facilitate the extraction of the said materials.

I claim:

1. A ski boot comprising (a) an outer shell element;

(b) a single-walled lining element defining, in conjunction with said shell element, a cavity adapted to receive a filler;

(c) means (3, 4; 10, 11; 12; FIGS. 5 to 13) for sealing said cavity, said sealing means being interposed between said shell element and said inner lining element to retain said filler and having a contour delimiting the extent of said sealed cavity;

(d) said sealing means comprising means (14; 20–26) for removably connecting said sealing means to at least one of said shell and inner lining elements, whereby said inner lining element is removably mounted in said shell element.

2. A ski boot according to claim 1 wherein said sealing means comprises a lip.

3. A ski boot according to claim 1 wherein said sealing means comprises a pad.

4. A ski boot according to claim 1 wherein said sealing means comprises an inflatable tube.

5. A ski boot according to claim 1 wherein said sealing means is integral with said inner lining element.

6. A ski boot according to claim 1 wherein said sealing means is integral with said shell element.

7. A ski boot according to claim 1 wherein said sealing means is fitted to said inner element.

8. A ski boot according to claim 1 wherein said sealing means is fitted to said shell element.

9. A ski boot according to claim 1 wherein said sealing means is produced by molding during moulding of said inner element.

10. A ski boot according to claim 1 wherein said sealing means is produced by molding during molding of said outer shell element.

11. A ski boot according to claim 4, wherein said inflatable tube is deflated after said filler has been introduced into said cavity.

12. A ski boot according to claim 1 wherein said sealing means comprises a collar mounted upon said shell element and comprising a rubber band at the inner edge thereof.

13. A ski boot according to claim 1 wherein said cavity communicates with the outside of said ski boot through an orifice permitting injection of said filler.

14. A ski boot according to claim 1 wherein said shell element is lined with an anti-adhesive product.

* * * * *